US005996711A

United States Patent [19]

Ohmer

[11] Patent Number: 5,996,711

[45] Date of Patent: Dec. 7, 1999

[54] METHOD AND APPARATUS FOR LOCATING INDEXING SYSTEMS IN A CASED WELL AND CONDUCTING MULTILATERAL BRANCH OPERATIONS

[75] Inventor: Herve Ohmer, Houston, Tex.

[73] Assignee: Schlumberger Technology Corporation, Sugar Land, Tex.

[21] Appl. No.: 09/049,958

[22] Filed: Mar. 27, 1998

Related U.S. Application Data

[60] Provisional application No. 60/043,818, Apr. 14, 1997.

[51] Int. Cl.[6] ..... E21B 7/08; E21B 47/02

[52] U.S. Cl. ..... 175/61; 166/255.2

[58] Field of Search ..... 166/117.5, 255.2, 166/55.6, 117.6; 175/61, 81

[56] References Cited

U.S. PATENT DOCUMENTS

| | | | |
|---|---|---|---|
| 3,704,749 | 12/1972 | Estes et al. | 166/255.2 |
| 4,685,092 | 8/1987 | Dumont . | |
| 4,852,666 | 8/1989 | Brunet et al. | 175/61 |
| 4,970,695 | 11/1990 | Huau . | |
| 5,216,638 | 6/1993 | Wright . | |
| 5,394,950 | 3/1995 | Grades | 175/45 |
| 5,409,060 | 4/1995 | Carter | 166/117.5 X |
| 5,477,923 | 12/1995 | Jordan, Jr. et al. . | |
| 5,579,829 | 12/1996 | Comeau et al. | 166/117.6 |
| 5,678,643 | 10/1997 | Robbins et al. | 166/255.2 X |
| 5,785,133 | 7/1998 | Murray et al. | 175/61 |

*Primary Examiner*—Frank Tsay
*Attorney, Agent, or Firm*—James L. Jackson; Wayne I. Kanak

[57] ABSTRACT

A method and apparatus for positioning and accurately orienting well service equipment within a well casing having an indexing coupling therein to permit the conduct of selected well service operations. A well logging sonde including an ultrasonic scanner system is run into the well casing and, in addition to conducting a conventional well survey, provides accurate measurement of the internal geometry of the indexing couplings and produces an acoustic image specifically identifying internal features such as landing profile and orienting slot orientation relative to earth frame references such as vertical, horizontal, and magnetic north. The present invention also provides for location and characterization of casing imperfections, such as internal and external corrosion, and variations in casing wall thickness, and also permits location of marker devices such as magnetic and radioactive markers. The ultrasonic logging sonde produces a well log specifically identifying the location and orientation of each indexing coupling, thus enabling subsequent well operations, such as the drilling of lateral branches, to be designed and controlled.

27 Claims, 7 Drawing Sheets

| type of profile | Indexing Profile Form Factors | | |
|---|---|---|---|
| | A/T | B/T | C/T |
| 1 | $\alpha 1$ | $\beta 1$ | $\delta 1$ |
| 2 | $\alpha 2$ | $\beta 2$ | $\delta 2$ |
| i | $\alpha i$ | $\beta i$ | $\delta i$ |

METHOD AND APPARATUS FOR LOCATING INDEXING SYSTEMS IN A CASED WELL AND CONDUCTING MULTILATERAL BRANCH OPERATIONS

CROSS REFERENCE TO RELATED APPLICATIONS

This application claims priority from Provisional Application 60/043,818, filed on Apr. 14, 1997, which is incorporated herein by reference.

This application is related to patent application Ser. No. 08/937,032, filed on Sep. 24, 1997.

BACKGROUND OF THE INVENTION

1. Field of the Invention

This invention relates generally to the drilling of wells for the production of petroleum products from subsurface zones of interest and to drilling activities for multilateral branches that extend from a primary wellbore to a zone or zones of interest located laterally from the primary wellbore. More particularly, the present invention is directed to a survey method and apparatus to record the position and the orientation of locating devices in a string of well casing, and to recognize the type of matching profile of the locating and orienting device that has been installed in the casing string at a specific well depth, to thus enable lateral branch operations such as casing window milling, lateral branch drilling, lateral branch entry, completion, and treating, to be accomplished simply and efficiently from the primary wellbore.

2. Description of the Related Art

In order to drill lateral branches in an oil and gas well, some side-tracking methods may use a permanent locating and orienting device that is built into the casing. Typically an indexing coupling is connected between sections of casing and defines an internal landing profile allowing a well tool having a matching internal landing profile to be landed and latched therein. For the purpose of indexing, the indexing coupling can also define an internal orienting slot having an azimuth that is known. A lateral branch well tool having an orienting key located within the orienting slot will therefore be oriented with respect to the azimuth of the internal orienting slot. Such a permanent indexing coupling allows positioning and orienting accurately and consistently any equipment that is needed to build and/or complete a lateral branch or conduct other azimuth specific operations within the well. This technique is disclosed in U.S. patent application Ser. No. 08/937,032, filed on Sep. 24, 1997, which is incorporated herein by reference.

Typically, sections of well casing are connected by threaded couplings so that the relative rotational positions of adjacent casing sections can vary significantly. The same is true with respect to indexing couplings which are typically connected to adjacent casing sections by threaded joints. To achieve precision location of indexing couplings within casing strings for wells of significant depth, according to conventional practices, the location and orientation of each joint of the casing string relative to adjacent joints must be precisely measured. Additionally, other parameters that control casing positioning, casing stretch for example, must be carefully monitored and controlled as the casing is being positioned and cemented within the wellbore so that the indexing coupling will be located precisely at the desired depth and the indexing slot of the indexing coupling will be precisely located at a preselected azimuth. As the many casing sections of a well are connected, minor errors at a number of casing joints can accumulate, thus positioning the orienting slot of any particular indexing coupling at an azimuth that is significantly different from the azimuth that is intended. Thus azimuth specific subsurface operations conducted from the reference of the indexing slot of the indexing coupling can have a significant error. Moreover, when the casing cementing operation has been completed the position of the well casing will be permanent, thus any error of casing positioning will interfere permanently with lateral branch operations.

Obviously, when exceptionally close monitoring and recording is being done during casing installation to ensure that actual indexing coupling positioning and orientation precisely matches the casing installation plan, the cost of the casing installation procedure, as compared to casing installation without such monitoring, is significantly increased, thus adversely influencing the overall cost of the well drilling and completion procedure. It is desirable therefore to provide a procedure for installing well casing having indexing couplings located therein so that the well casing can be installed without the need for precision azimuth controlled orientation of the indexing couplings relative to the earth formation. It is also desirable to provide a procedure for efficiently and accurately identifying the specific azimuth orientation of each of the orienting couplings of a casing string after the casing string has been run into the wellbore and cemented. This feature will permit the well tools to be landed therein to be selectively oriented with respect to the precisely measured existing azimuth of the orienting slot of the indexing coupling so that intended well operations, the drilling of lateral branches, well completion activities, well treating, casing window milling, digital imaging, as examples, can be carried out from an azimuth reference and coupling orientation that have been precisely measured and recorded by a well log.

When a well casing is installed, landing and indexing nipples, also referred to herein as indexing couplings are frequently connected in the casing string at selected depths to enable well tools to be run through the casing and landed and latched to the internal profile of the indexing coupling. At times the internal profiles of several indexing couplings of a casing string will be intentionally different so that only a well tool having a matching landing profile can be landed and latched therein. This feature enables well tools to be run through the casing string and through non-matching indexing couplings until an indexing coupling having a matching profile has been reached. The landing nipple with a matching profile will allow the locking dogs of the tool to seat within the matching profile and establish a latching connection therewith.

Under circumstances where an existing well having indexing couplings, particularly indexing couplings having an orienting slot therein, are encountered and the internal profile and indexing geometry and orientation are not known, it is desirable to provide a system for creating an image of the internal geometry of the indexing coupling on a well log and referencing the image to local deviation and rotation, i.e., the inclination of the well casing and indexing coupling and the angle of rotation, measured from an azimuth of reference such as magnetic north. The image so created should display the positioning and orienting features of the indexing coupling, i.e., the precise internal profile of the indexing coupling and the azimuth and dimension of its indexing slot so that azimuth specific lateral branch operations may be efficiently designed and conducted from the reference of the indexing slot.

It is therefore desirable to provide a logging system having an ultrasonic scanner to thus provide the capability of creating an image accurately identifying the internal geometry of the indexing coupling or other positioning or indexing device. It is also desirable to provide a logging system having the capability of correlating the image of the internal geometry of the selected indexing coupling in terms of local references in the downhole environment. This will enable various azimuth specific downhole operations to be designed with the known internal geometry and orientation of a selected indexing coupling in mind.

SUMMARY OF THE INVENTION

It is a principal feature of the present invention to provide a novel method and apparatus for identifying the internal profile and the specific indexing azimuth of a selected indexing coupling of a casing string and to selectively orient various multilateral branch tools in landed and indexed relation therein for the purpose of simply and efficiently conducting casing window milling, lateral branch drilling, completion, and entry from a primary cased wellbore.

It is another feature of the present invention to provide a novel survey method and apparatus to detect and record the position and the orientation of well tool orienting devices which have been permanently installed within the casing string of a cased well to thus provide a reference from which azimuth specific lateral branch operations can be conducted.

It is another feature of the present invention to provide a novel survey method and apparatus which eliminates the need to establish precisely measured relationships of the joints of a casing string in reference to one another and to establish precisely measured azimuth relationships of orienting couplings to adjacent casing sections during installation of the casing string within the wellbore.

It is an even further feature of the present invention to provide a novel survey method and apparatus providing surrounding formation characterization, casing characterization and indexing coupling characterization in a well reference log to thus enable subsequent azimuth specific well operations such as lateral branch drilling, completion and servicing to be efficiently designed and conducted.

It is also a feature of the present invention to provide a novel survey method and apparatus employing ultrasonic scanning from a logging sonde located within the well casing to thus produce an acoustic image identifying the specific location and landing profile of a selected indexing coupling of a casing string to thus enable a well tool with a matching landing profile to be selected for landing therein and accurately oriented for carrying out azimuth specific downhole well operations such as milling casing windows, aligning lateral branch drilling tools with respect to previously milled casing windows, and aligning lateral branch completion and well servicing tools with drilled lateral branches for ease of lateral branch reentry.

It is another feature of the present invention to provide a novel survey method and apparatus which employs ultrasonic scanning for the additional purpose of cement characterization to determine the integrity of the completed well.

It is an even further feature of the present invention to provide a novel method for identifying markers, such as internal, embedded, and external magnetic or radioactive markers of the well casing and for locating permanent casing structures such as valves, cables, sensors, prefabricated casing exits, and the like, and showing the same on a well log. Briefly, for the purpose of conducting lateral branch drilling, completion and servicing activities from a primary wellbore, the present invention concerns a survey method and apparatus to detect and record the position and the orientation of indexing devices that have been installed within a well in permanent assembly with the well casing. The present invention also provides for recognition of the type of matching internal profile and indexing azimuth of an indexing coupling that has been installed at a specific depth and to correlate these landing and indexing features with other parameters which characterize the well casing and/or the formation that surrounds the well casing.

For detecting the location of a selected indexing coupling of a casing string, a logging sonde having an ultrasonic scanner for ultrasonic wave propagation and detection is run into the casing string on a wireline, tubing string, coiled tubing, or by any other suitable means. The ultrasonic scanner can simultaneously investigate the internal casing and indexing coupling geometry in a radial cross-section and can also monitor various other downhole features including casing corrosion and the quality of the cement bond between the casing and formation. An ultrasonic wave propagated in the well fluid by the ultrasonic scanner is partly reflected by the inner casing interface thus providing an echo. Processing this echo versus the angle of rotation and versus depth creates an acoustic image of the orienting and positioning features that are defined within the particular orienting coupling within which the logging sonde is located. The acoustic image is then electronically referenced to local wellbore deviation from vertical and relative azimuth angle measured by an inclinometer that is incorporated within the logging sonde. In situations where the well is substantially vertical and therefore has no deviation or has only slight deviation, a gyroscope is combined with the ultrasonic scanner in order to provide the azimuthal reference that is needed to locate the orienting features on the resulting well log. A gamma-ray log can be simultaneously run in combination with ultrasonic scanning to indicate the amount of shales contained in the formation that is penetrated by the cased well, and thus helps define the position of a future lateral branch using geological markers.

The logging equipment consists of a logging acquisition system installed or located at the earth's surface and electronically connected to a wireline logging cable. A downhole logging tool or sonde is connected mechanically and electrically to the wireline cable for physical positioning within the cased well and for electronic operation and control. The logging sonde supports a combination of sensors measuring simultaneously the following parameters: (a) apparent depth measured along the well; (b) tri-dimensional acceleration; (c) natural gamma-ray energy measured across the casing; (d) an acoustic image measured by a high resolution ultrasonic scanner of the logging tool; and (e) azimuth of the logging tool with respect to earth magnetic north, measured by a gyroscope under circumstances where wellbore deviation is very low (in the range of 5° to 10° or less). In addition to identification of the internal geometry of an indexing coupling of a well casing, the present invention employs attributes that provide a number of other features. The present invention enables detection and measurement of geometric casing features associated with permanent sensors, valves, or cabling located within the wellbore and exteriorly of the well casing. The invention enables detection and measurement of prefabricated casing exits which are provided to adapt the well for branch bore drilling after the primary well casing has been installed. Other locating features of the well casing, such as magnetic anomaly markers, radioactive markers, and the like, may be efficiently located utilizing the various features of the present invention.

The common meaning of the word "azimuth" is an angular distance, measured clockwise in the northern hemisphere, in angular degrees using magnetic north as a reference. An azimuth measurement is typically meant to be measured with the horizon as a reference. It should be understood that the wellbore under consideration with respect to azimuth measurement may be vertically oriented, horizontally oriented, or may be oriented at a deviated inclination between the vertical and horizontal. Also, a branch bore may be drilled at a selected azimuth from a primary wellbore regardless of the particular orientation or inclination of the primary wellbore. Thus, from the standpoint of the present invention the term "azimuth" is intended to mean a measured angular direction measured with respect to the earth's gravity and measured in a direction that is transverse to the particular wellbore or branch bore being so measured. With the location, orienting azimuth and internal profile of the various indexing couplings of a casing string precisely known, lateral branch well tools, such as casing window milling tools, branch drilling tools, and lateral branch completion and servicing tools may be run through the well casing to a selected indexing coupling. The tools are provided with an indexing device thereon which defines a matching profile for landing within the selected indexing coupling and defines an orienting key which is received within the orienting slot of the indexing coupling to thus orient the tools with respect to the azimuth of the indexing coupling. To enable azimuth specific lateral branch operations with respect to an azimuth that differs from the azimuth of the orienting slot of the indexing coupling, the indexing device of the lateral branch tool is rotationally adjusted with respect to the reference of the orienting key. With the azimuth of the orienting slot of the indexing coupling identified by the logging sonde, the azimuth of a lateral branch can be easily established by selected rotational adjustment of the lateral branch tool with respect to an index mark on the indexing device of the tool. Whether the lateral branch tool is a casing window milling tool, a branch drilling tool, a branch completion tool, or any other type of well servicing tool, when its indexing device is landed within and indexed by the indexing coupling, the tool will be precisely oriented and aligned with the casing window and lateral branch bore, without necessitating the usual time consuming, difficult, and expensive alignment procedures that are conventionally done.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings.

It is to be noted however, that the appended drawings illustrate only a typical embodiment of this invention and are therefore not to be considered limiting of its scope, for the invention may admit to other equally effective embodiments.

DESCRIPTION OF THE PREFERRED EMBODIMENT

Figure 1:
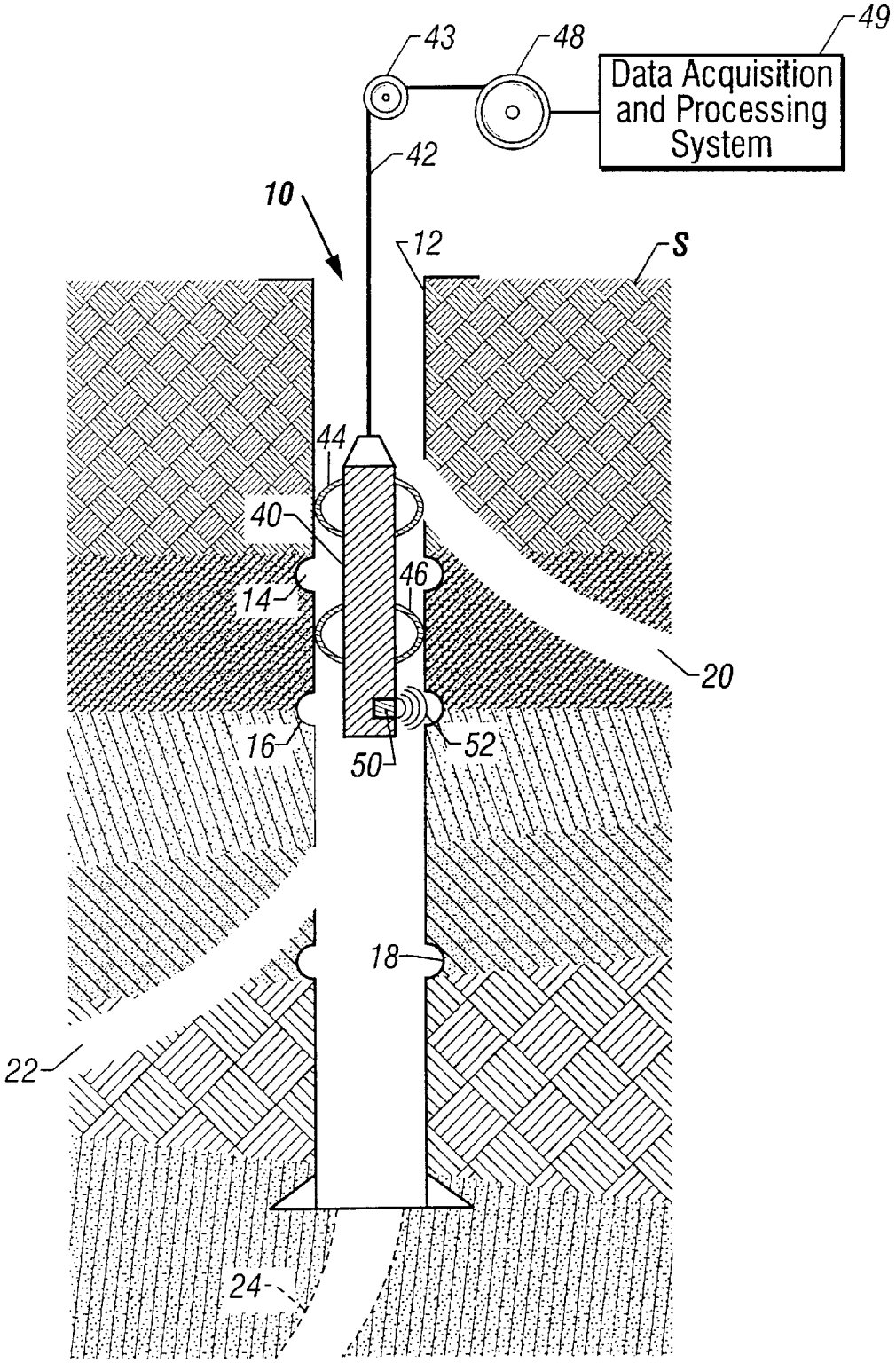
FIG. 1 is a schematic illustration in section showing a well drilled in the earth and lined with a well casing having a plurality of indexing couplings therein and showing a survey instrument being positioned within the well casing and acquiring an acoustic image of one of the indexing couplings of the well casing, and further showing lateral branches extending from the primary wellbore according to the teachings of the present invention.

Referring now to the drawings and first to FIG. 1, a schematic illustration is shown wherein a primary well shown generally at 10 is drilled into the earth and is lined with a well casing 12 which extends to a desired depth. The well casing 12 is provided with a plurality of indexing couplings 14, 16 and 18 which are positioned at depths that are selected to permit their use in connection with future operations such as well completion and production activities, and locating devices from which the drilling of lateral branches, as shown at 20 and 22 can be controlled. Indexing couplings are utilized for locating azimuth specific lateral branch tools such as casing window milling tools, branch drilling tools, branch completion tools, and various other well tools for the purpose of drilling, completion, and servicing operations. For example, an axial branch wellbore 24 is drilled by a branch bore drilling tool that is landed and indexed with respect to the indexing coupling 18 and may be curved or otherwise deviated from the principal wellbore 10 as desired to intersect a particular subsurface zone that may not have been identified until the well was subjected to logging. The lateral branch bores 20 and 22 are drilled and completed by lateral branch tools that are landed and indexed by the indexing couplings 14, 16 or 18 as the case may be. These lateral branch bores are typically azimuth specific and are established by selectively orienting the respective lateral branch tools with respect to the known azimuth of the respective indexing coupling.

Figure 2:
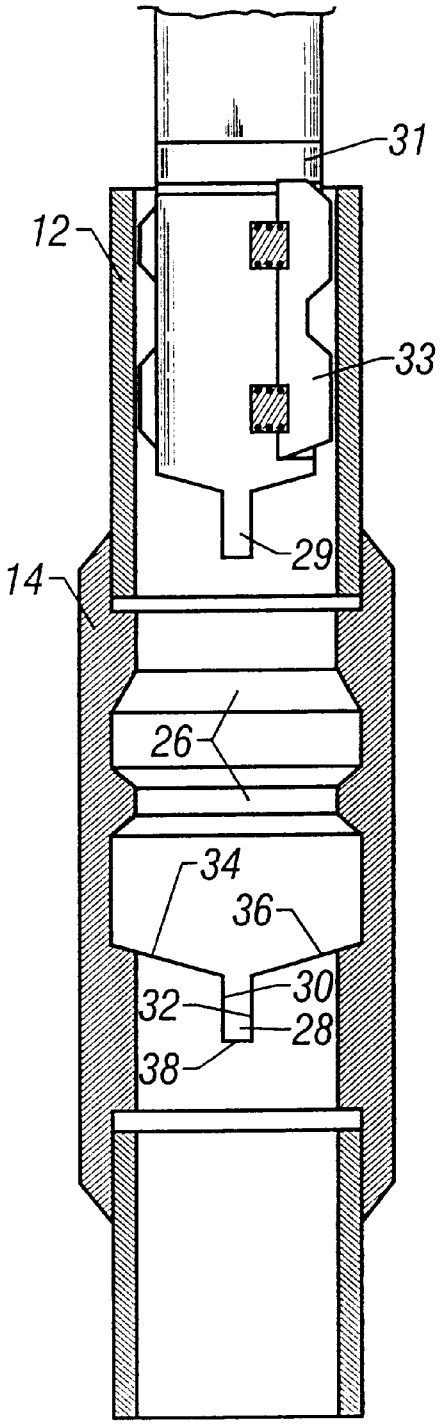
FIG. 2 is a front sectional view of an indexing coupling mounted in a casing string.
Figure 3:
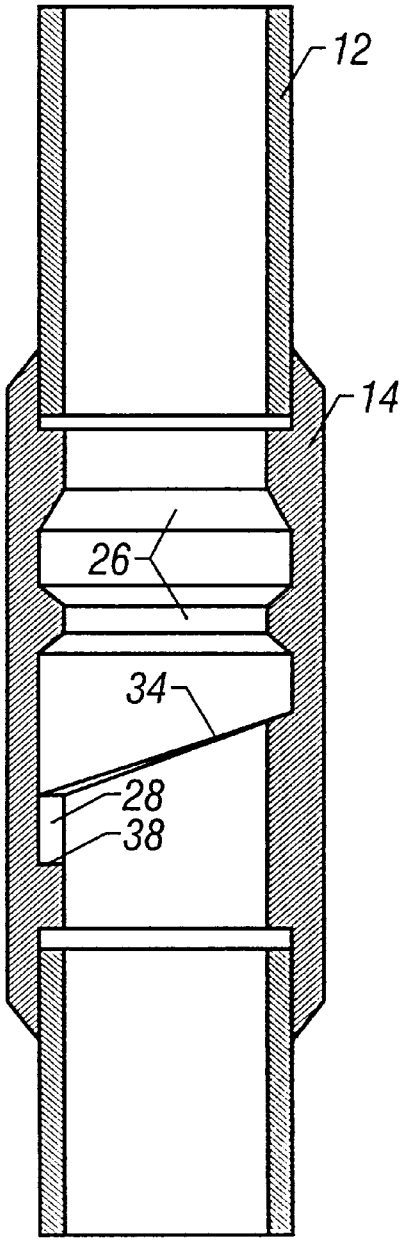
FIG. 3 is a side sectional view of the indexing coupling of FIG. 2.

Referring now to FIGS. 2 and 3 of the drawings, a representative indexing coupling 14, i.e., positioning and azimuth indexing coupling, is shown connected within the well casing 12. The indexing coupling defines a selected internal landing profile 26 having circular lands and grooves of a geometry matching the geometry of a well service tool to be landed and oriented therein. The indexing coupling 14 also defines an orienting slot 28 which can be of any suitable configuration, but which is preferably of generally rectangular cross-sectional configuration for receiving the orienting key 29 of an oriented well tool 31 in close fitting relation therein so that the well tool 31, for example of the type described in U.S. patent application Ser. No. 08/937,032, filed Sep. 24, 1997, will be precisely oriented with respect to both depth and azimuth. The generally rectangular orienting slot 28 defines parallel side surfaces 30 and 32 which provide precise orientation of the respective parallel side surfaces of the orienting key 29 of the well tool 31 according to known technology. The well tool 31 is preferably provided with latching dogs 33 having a profile matching the internal landing profile 26 of the indexing coupling 14 so that when the latching dogs 33 are in registry with the internal landing profile they will become seated therein. The well tool 31 is then subjected to latching activity for the purpose of securing the well tool 31 in latched relation within the indexing coupling 14. The well tool 31 will remain latched within the indexing coupling 14 until it is subsequently unlatched by controlled operation of the latching mechanism thereof. The indexing coupling 14 also defines inclined internal curved guide ramp surfaces 34 and 36 which are engaged by the orienting key 29 of the well tool 31 and which function as cam surfaces to rotate the orienting key and thus the well tool as the well tool is moved downwardly in contact therewith. These guide ramp surfaces and the orienting slot 28 are typically defined by a "mule shoe" device located within and fixed to the indexing coupling 14. When the orienting key 29 comes into contact with either of the guide ramp surfaces 34 or 36, rotary motion will be imparted to the orienting key 29 and to the well tool 31 with which the orienting key is adjustably positioned. When the orienting key 29 has been so rotated to its desired azimuth, the orienting key will be in registry with the orienting slot 28 and thus will be moved downwardly within the orienting slot 28 until its further downward movement is stopped by the upwardly facing stop surface 38 of the indexing coupling 14. With this downward movement of the well tool 31 within the indexing coupling 14 the latching dogs 33 will move into registry with the internal landing profile 26 of the indexing coupling, typically by spring force. At this point the latching mechanism of the well tool 31 will be actuated, causing the latching dogs 33 to be locked at the radially extended positions thereof, thus latching the well tool in substantially immovable relation within the indexing coupling 14.

As further shown in FIG. 1, a logging sonde 40 is adapted to be run into the well casing 12 of the well 10 by a wireline logging cable 42, while being centered within the casing by centralizer elements 44 and 46 thereof. The wireline logging cable 42 is directed by one or more pulleys 43 and is taken up by the wireline winch 48 of a data acquisition and processing system 49 that is located at the earth's surface S. It should be borne in mind that the logging sonde 40 may alternately be conveyed by jointed pipe or coiled tubing, or by any other suitable means, without departing from the spirit and scope of the present invention. The logging sonde 40, in addition to conventional well logging systems, is provided with an ultrasonic scanner system 50, such as, for example, that described in U.S. Pat. No. 4,970,695, which is incorporated herein by reference. The ultrasonic scanner system 50 propagates acoustic waves as shown at 52 through the fluid within the well casing 12. The ultrasonic scanner system 50 incorporates an internal rotary element which rotates narrow acoustic waves, known as an "ultrasonic spot" so that first echo transit time from the internal profile of the indexing coupling 14 is electronically processed to accurately establish an acoustic image of the internal profile of the indexing coupling. A portion of the acoustic waves 52 is reflected by the internal surface defined by the well casing 12 or the indexing coupling 14 that is located about the logging sonde 40 and a portion of the acoustic waves 52 propagates through the well casing 12 and can be used to detect the integrity of the casing and the integrity of the well casing and the integrity of the cement that fills the annulus between the well casing and the wellbore wall. The ultrasonic scanner system 50 incorporates a reflected wave or echo detector which detects and processes the first echo arrival and provides logging signals that are then processed to provide accurate location of the indexing coupling 14, to clearly identify its internal landing profile, to precisely locate the azimuth of the orienting slot within the indexing coupling, and to identify the orientation of the orienting coupling with respect to the vertical, the horizontal, and a reference azimuth such as magnetic north.

Figure 4:
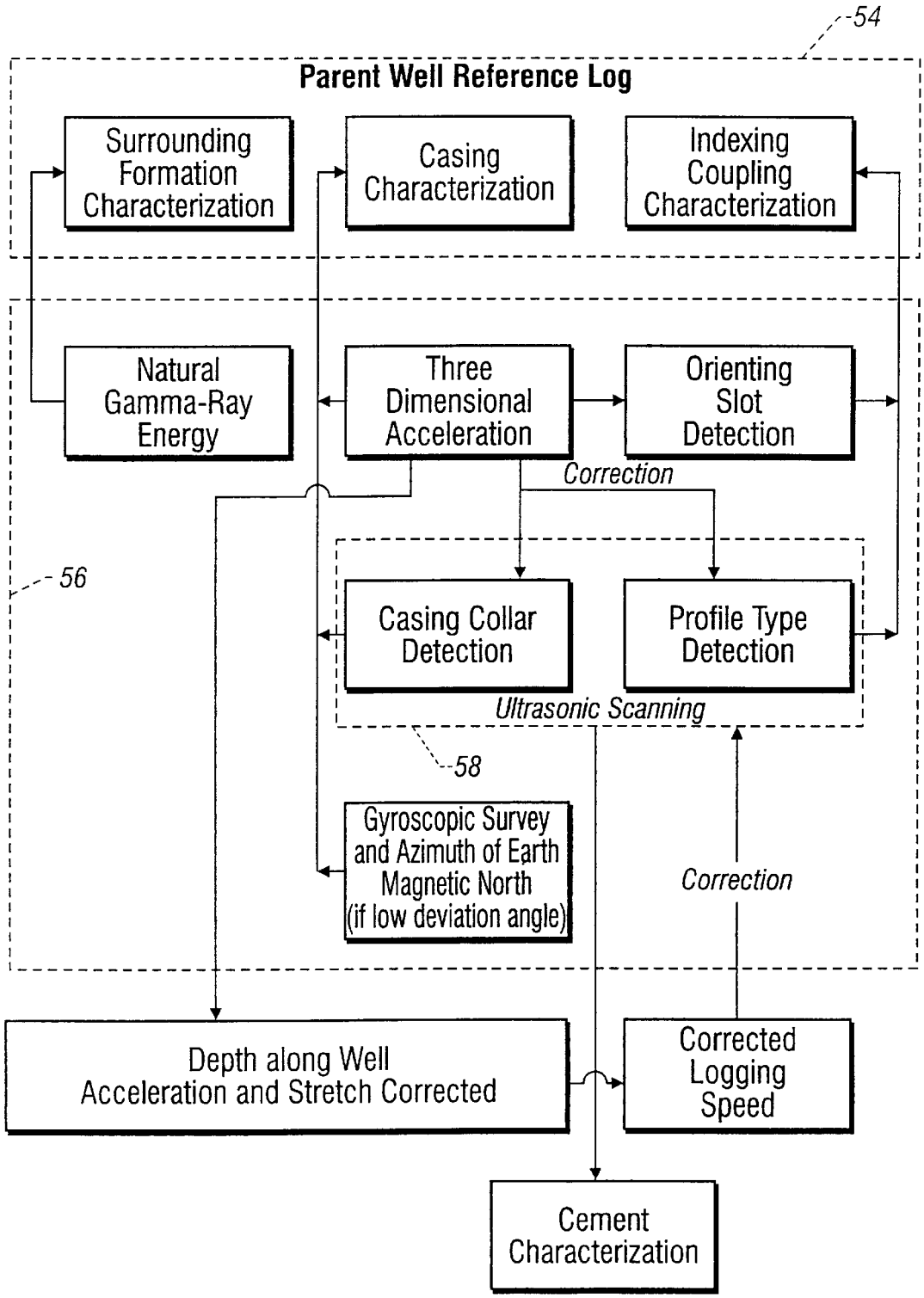
FIG. 4 is a block diagram illustrating the method of combining logging data in a survey to determine the location of indexing couplings according to the present invention.

Referring now to FIG. 4, the block diagram illustrates three basic components of characterization that make up combined logging data in a survey to determine the location and orientation of indexing couplings. As shown in the upper broken line block 54 of FIG. 4, data representing surrounding formation characterization, casing characterization, and indexing coupling characterization are utilized to generate a parent well reference log. Natural gamma-ray energy is employed according to conventional practices to provide data characterizing the surrounding formation. This data enables well completion activities and also enables the owner of the well to later design branch bores drilled from the parent wellbore for the purpose of intersecting subsurface zones located near the well but inaccessible to production by the parent wellbore. Casing characterization according to FIG. 4 employs data from various sources such as a three-dimensional accelerometer and casing collar detection, including indexing coupling detection. Additionally, in the event the deviation angle of the wellbore is low, data from a gyroscopic survey and the azimuth of the earth magnetic north is also employed for casing characterization as shown in the broken line block 56 of FIG. 4. The broken line block 58, as well as the broken line block 56, of FIG. 4 represents data in the form of an acoustic image that is acquired by ultrasonic scanning and includes casing collar detection and detection of the various indexing couplings of the casing string, as well as data representing the internal profile of each of the indexing couplings. The specific landing profile of each indexing coupling and the azimuth orientation of the orienting slot of the indexing coupling are needed when operations are subsequently carried out by well tools that require azimuthal orientation. Other data input, such as depth measured along the well casing, acceleration of the logging sonde within the well casing, and wireline or coiled tubing stretch are also required data inputs for accurately locating the indexing couplings. Data reflecting corrected logging speed of the sonde is also utilized in the data processing in connection with ultrasonic scanning to define orienting slot location and achieve data presenting indexing coupling characterization.

A casing equipped with indexing couplings and potentially also equipped with marker elements, such as internal, external, or embedded magnetic or radioactive marker elements, and equipped with prefabricated casing exits and the like is lowered in an open hole and cemented. At this stage, it is not necessary that the specific azimuthal orientation of the orienting slots of each of the indexing couplings be controlled. It is only desirable, but not absolutely necessary, that the positions of the various indexing couplings be rather precisely controlled with respect to well depth. The type of key profile and the coordinates of each of the indexing couplings, including the azimuthal orientation of the orienting slot of each of the indexing couplings, should be accurately known in order to define the drilling plan of future lateral branches and to adjust the side-track tooling adequately. Some of these indexing couplings may use different matching key profiles so a running tool will run through non-matching indexing couplings and become seated in only one given indexing coupling having a matching internal profile. These local references can be defined by cased hole logging with ultrasonic scanning as shown in FIG. 1.

Figure 5:
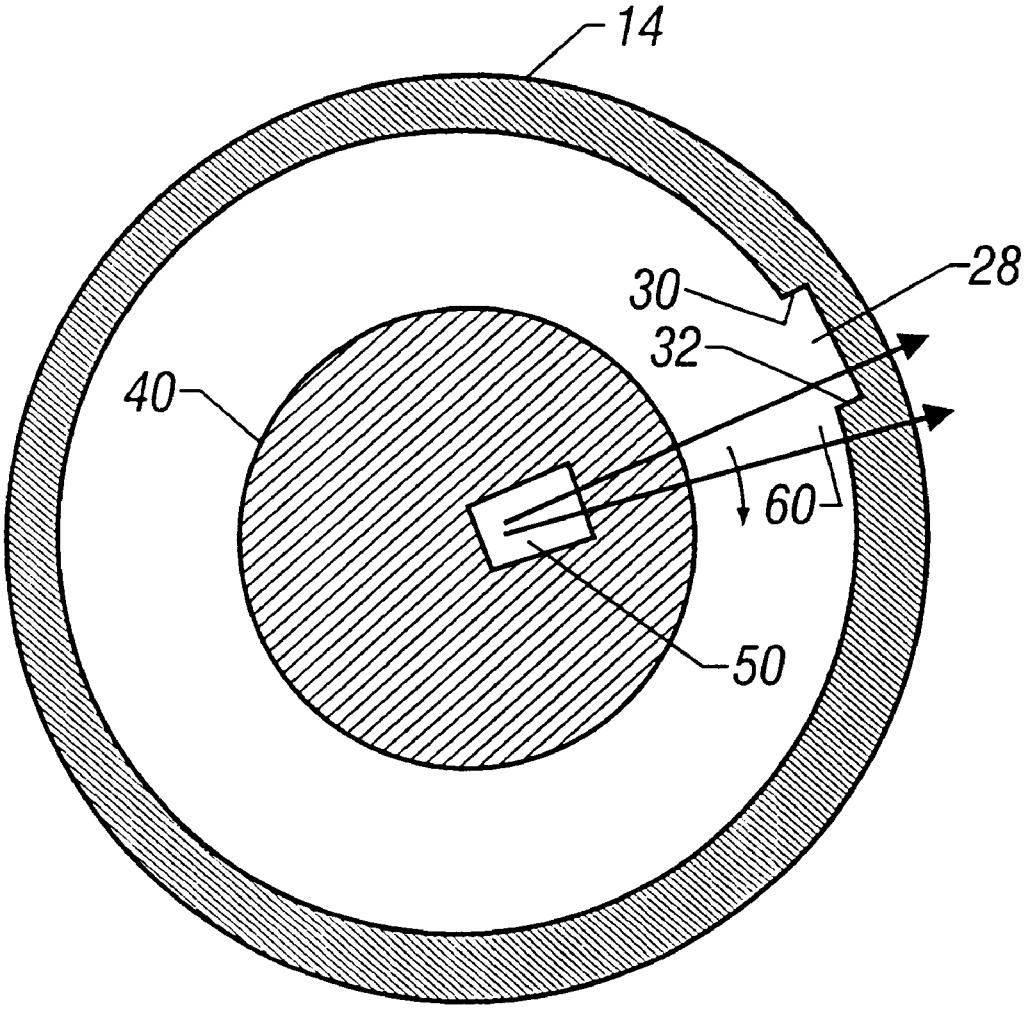
FIG. 5 is a transverse sectional view of an indexing coupling of a well casing such as that shown in FIGS. 2 and 3, showing a logging sonde located within the well casing and operating for locating the internal profile and orienting slot of the indexing coupling.

Referring now to FIG. 5, a logging sonde 40 having ultrasonic imaging capability is shown to be centralized within an indexing coupling 14. The ultrasonic scanner system 50 of the logging sonde 40 is provided with a rotating mechanism for rotating a narrowly focused ultrasonic wave or "ultrasonic spot" 60 enabling initial reflection of the ultrasonic wave by the inner surface of the indexing coupling 14. By electronically measuring the difference of first wave arrival time reflected from components that define the surface geometry of the internal landing profile of the indexing coupling 14, the internal landing profile and the azimuth of the orienting slot 28 provide reflected data that is electronically processed to provide a log specifically characterizing the internal geometry of the indexing coupling 14. From data provided by the log, well tools can be precisely oriented in order to carry out subsequent operations, such as the drilling of lateral branch bores at a specific azimuth from the primary wellbore. Well tools being landed within selected indexing couplings can mill casing windows, provide well treating activities, conduct lateral branch drilling, accomplish well completion, and conduct many other operations that are desired in lateral branch well drilling and completion procedures. This method may also be employed to enter a well having indexing couplings when the internal profile and the orienting slot are not known, and to quickly and efficiently characterize the indexing coupling according to the procedure that is set forth above.

The present invention is additionally adapted for characterization of the well casing. By processing ultrasonic wave reflections or echos from the well casing, the internal and external surface geometry of the casing becomes evident and the thickness of the well casing at any given well depth also becomes evident. This feature enables the casing of existing wells to be inspected along their entire depth so that internal and external corrosion, holes, weakened regions, and the like can be accurately and efficiently measured.

Figures 6, 7:
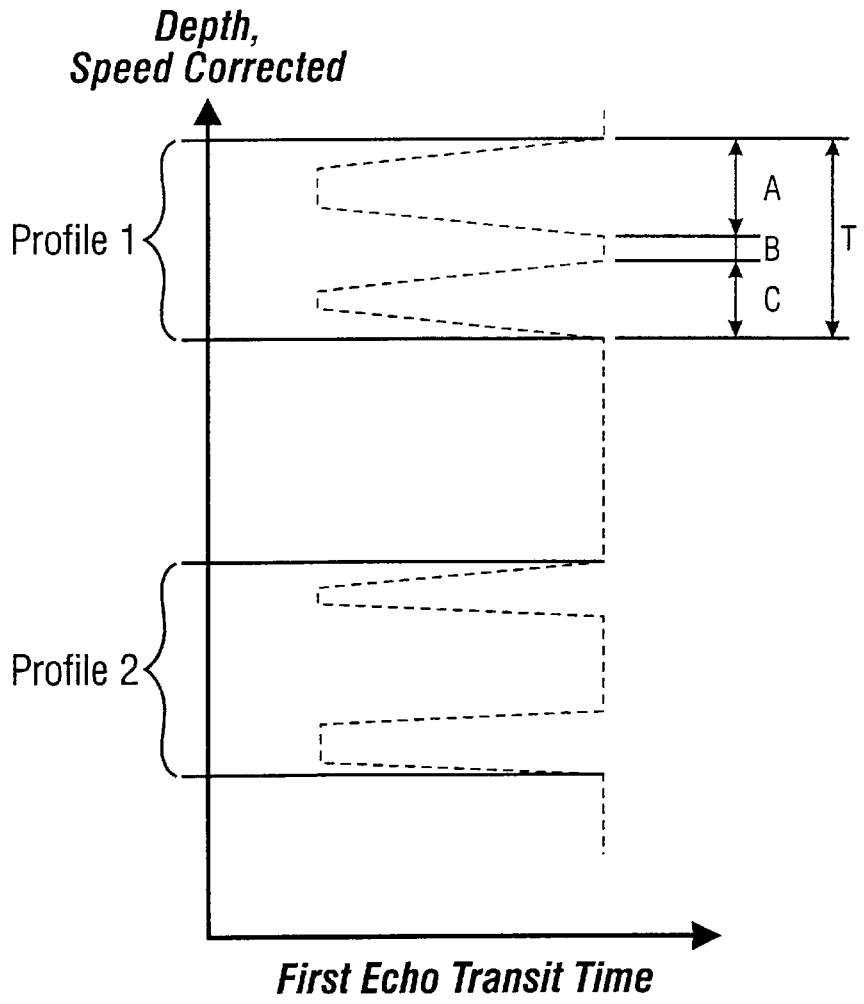
FIG. 6 is a graphical representation of first echo transit time as a function of speed corrected depth showing recognition of a specific landing profile of an indexing coupling of a well casing by ultrasonic scanning.
FIG. 7 is a tabular representation of indexing profile form factors according to the graphical representation of FIG. 6.

Referring now to FIGS. 6 and 7, the scanning response of internal landing profiles of indexing couplings of a casing string is illustrated in FIG. 6. A, B, C, T are the images of actual landing profiles measured by ultrasonic scanning along the well axis. Normalizing A, B, and C to the profile base T reduces the time-based image to a geometry-based image. A/T, B/T and C/T give respectively $\alpha$, $\beta$ and $\delta$ after correction of the instantaneous speed using the measurement of the logging sonde acceleration along the well. As a result, a given combination of calculated $\alpha 1$, $\beta 1$, and $\delta 1$ coefficients can determine the geometric form factor of one specific indexing profile.

Figure 8:
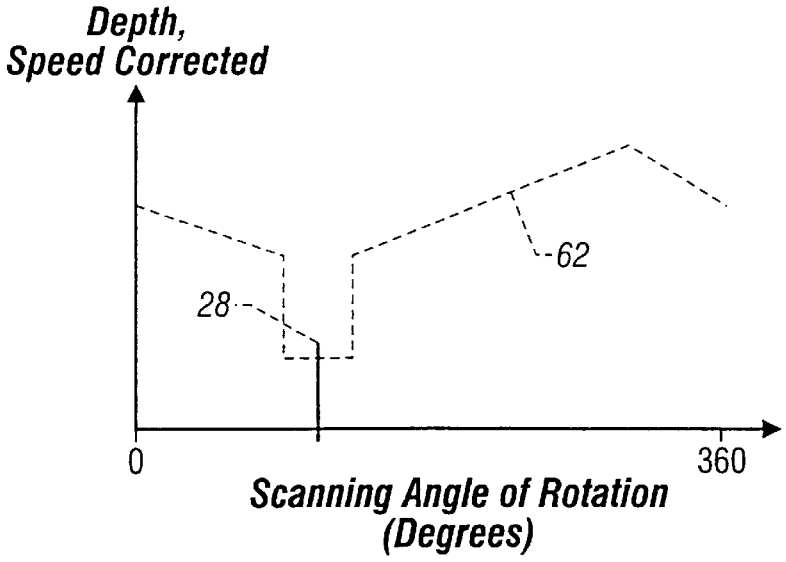
FIG. 8 is a graphical representation identifying the image of the orienting slot of an indexing coupling of a well casing as a function of speed corrected depth and scanning angle of rotation.

The graphical representation of FIG. 8 illustrates recognition of an orienting slot 28 of an indexing coupling by processing the reflected ultrasonic wave using differentiation of first echo transit time to define an acoustic image 62 which presents the image of the orienting slot 28 as a function of speed corrected depth and scanning angle of rotation. Logging tools of the type described in U.S. Pat. Nos. 4,685,092 and 4,970,695, both incorporated herein by reference, may be used to provide the data to produce such acoustic images.

Figure 9:
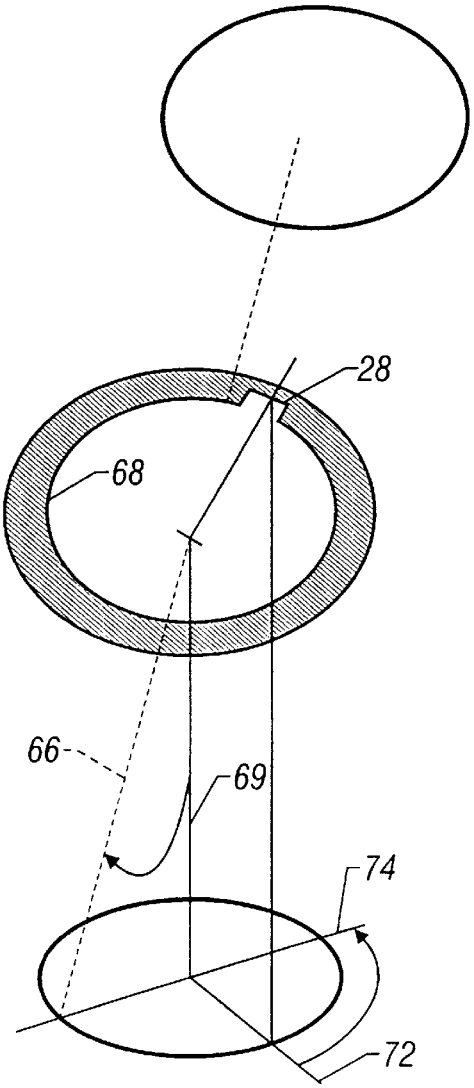
FIG. 9 is a schematic illustration showing the determination of the orientation of the local references of an indexing coupling of a well casing.

The schematic representation of FIG. 9 shows the determination of the orientation of the local references of an indexing coupling. The axis of the borehole and well casing is shown by broken line at 66, with the cross-section of the indexing coupling being shown at 68, and compared with a vertical reference 69 intersecting the centerline of the indexing coupling. The projection of the orienting slot direction in the horizontal plan is shown at 72. From the azimuth of the orienting slot 28 an azimuth of borehole deviation 74 can be calculated with respect to the low gravity point to enable the orienting key of the well tool to be specifically set for carrying out azimuth specific operations according to the selected azimuth of deviation. Thus, the drilling of azimuth specific lateral bores can be controlled by seating of the well tool in the indexing coupling and with the well tool being specifically designed to conduct well operations according to a desired azimuth.

In addition to identification of the internal geometry and specific measurements of an indexing coupling of a well casing, the present invention employs attributes that provide a number of other features. The present invention, without necessitating any significant changes in the ultrasonic sensing and well logging sonde, enables detection and measurement of various internal and external casing features. For example, geometric casing features associated with permanent sensors, valves, or cabling located within the wellbore and exteriorly of the well casing can be efficiently and accurately located and measured. The present invention also enables detection and measurement of prefabricated casing exits which are provided to adapt the well for branch bore drilling from casing exits after the primary well casing has been installed. Other locating features of the well casing, such as magnetic anomaly markers, radioactive markers, and the like, may also be efficiently and accurately located utilizing the various features of the present invention.

Figure 10:
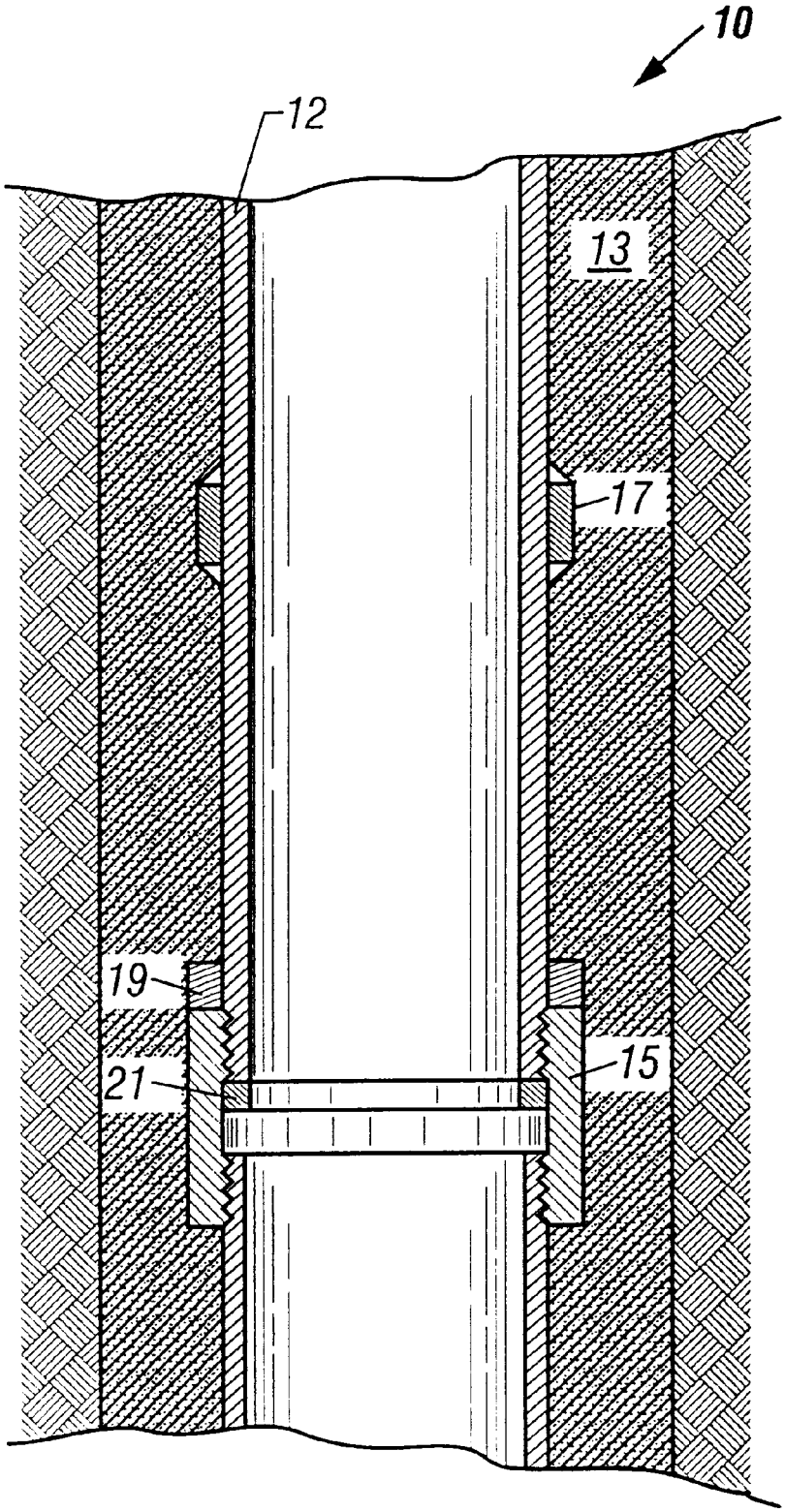
FIG. 10 is a partial sectional view of a cased well showing marker anomalies of a well casing or wellbore to aid in subsequent precision location thereof by a logging sonde.

As shown in FIG. 10, the well 10 may have a well casing 12 that is secured within the wellbore by cement 13 that is located in the annulus between the well casing 12 and the borehole wall. For purposes of location after the well casing 12 has been installed, the casing or one or more of its casing collars 15 may be provided with internally exposed or embedded marker devices 17, 19, or 21 which may be fixed to or about the casing in any suitable manner. The marker devices may also be located externally of the casing and may be fixed to the casing or located within the cement filling the annulus. The marker devices may be in the form of magnetic devices, radioactive devices, or may simply be in the form of objects which can be accurately detected by the on-board sensor instrumentation of the logging sonde 40. Downhole anomalies of the well casing created by permanent casing devices such as valves, cables, and prefabricated casing exits for lateral branch bores, can also serve as markers. These casing anomalies are capable of accurate and efficient location and characterization by the logging sonde so that a well log locating such devices can be prepared and utilized for further well construction and completion activities.

In view of the foregoing it is evident that the present invention is one well adapted to attain all of the objects and features set forth above, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description.

What is claimed is:

1. A method for constructing multilateral branches from a primary wellbore having a well casing having connected therein one or more indexing coupling devices having an orienting slot therein, said method comprising:

(a) running a logging sonde within said well casing and into a selected indexing coupling device;

(b) propagating an ultrasonic wave through well fluid within said well casing for reflection thereof from the internal surfaces of said selected indexing coupling device, and providing therefrom an acoustic image of said internal surfaces of said indexing coupling device;

(c) processing said acoustic image for reference thereof to local wellbore deviation and relative azimuth angle;

(d) landing a lateral branch tool within said selected indexing coupling device, said lateral branch tool having an adjustable orienting device defining an orienting member for mating azimuth indexed engagement within said orienting slot of said selected indexing coupling device and with said orienting member oriented at a selected azimuth angle with respect to said lateral branch tool; and (e) conducting lateral branch operations with said orienting device of said lateral branch tool in oriented engagement within said indexing coupling device.

2. The method of claim 1, wherein said lateral branch tool is a casing window milling tool and said step of conducting lateral branch operations comprises:

milling a window in said well casing at an azimuth angle determined in part by the azimuth angle of said orienting slot of said selected indexing coupling device and determined in part by the azimuth adjusted position of said orienting member of said adjustable orienting device of said casing window milling tool.

3. The method of claim 1, wherein said lateral branch tool is a lateral branch drilling tool and said step of conducting lateral branch operations comprises:

drilling a lateral branch bore with said lateral branch drilling tool oriented at a selected azimuth angle determined in part by the azimuth angle of said orienting slot of said selected indexing coupling device and determined in part by the azimuth adjusted position of said orienting member with respect to said lateral branch drilling tool.

4. The method of claim 1, wherein said lateral branch tool is a lateral branch entry tool for guiding well tools from said primary cased wellbore through casing windows and into lateral branch bores and said step of conducting lateral branch operations comprises:

running a tool through the well casing and into guiding engagement with said lateral branch entry tool, said lateral branch entry tool guiding said tool from said well casing and into the selected lateral branch.

5. The method of claim 1, further comprising:

(f) recording said local wellbore deviation and said relative azimuth angle referenced acoustic image in a well log.

6. The method of claim 5, further comprising:

(g) referencing said acoustic image to local wellbore deviation and relative azimuth angle to provide said well log with an azimuthal reference.

7. The method of claim 1, wherein said processing step comprises:

electronically converting said acoustic image from a time based image to a geometry based image.

8. The method of claim 1, wherein said propagating and imaging step comprises:

using differentiation of first echo transit time for generation of said acoustic image.

9. The method of claim 1, wherein said propagating and imaging step comprises:

(a) generating said ultrasonic wave from an ultrasonic scanner within said logging sonde;

(b) measuring differentiation of first echo transit time from said internal surfaces of said selected indexing coupling device to said ultrasonic scanner; and (c) recording said differentiation of first echo transit time to create said acoustic image.

10. The method of claim 9, further comprising:

referencing said acoustic image to local wellbore deviation and relative azimuth angle to provide a well log with an azimuthal reference.

11. A method for constructing multilateral branches in a cased well having one or more indexing couplings fixed therein, the indexing couplings having an internal profile and defining an orienting slot, said method comprising:

(a) running a well logging sonde into the well casing to a position within a selected indexing coupling, said logging sonde having an ultrasonic scanner therein;

(b) propagating an ultrasonic wave from said ultrasonic scanner through drilling fluid present within said well casing, thus causing ultrasonic wave reflection from the internal surfaces of said selected indexing coupling and providing an acoustic image of said internal surfaces;

(c) referencing said acoustic image of said internal surfaces of said indexing coupling to local deviation and relative azimuth angle to provide an azimuthal reference identifying the azimuth angle of said orienting slot;

(d) processing said acoustic image and generating a well log identifying the position and orientation of said selected indexing coupling, identifying said internal profile of said indexing coupling and identifying the azimuth angle of said orienting slot;

(e) running a lateral branch tool through said well casing and into landed relation within said selected indexing coupling, said lateral branch tool having an adjustable indexing device thereon defining an orienting key for orienting engagement within said orienting slot of said indexing coupling; and (f) conducting lateral branch operations from said well casing with said lateral branch tool oriented in part by said azimuth angle of said orienting slot of said indexing coupling and oriented in part by the adjusted position of said adjustable indexing device with respect to said lateral branch tool.

12. The method of claim 11, wherein said step of referencing said acoustic image of said internal surfaces of said indexing coupling to local deviation and relative azimuth angle comprises:

(a) processing said acoustic image versus angle of rotation; and (b) processing said acoustic image versus depth.

13. The method of claim 11, wherein said step of providing said azimuthal reference comprises:

(a) measuring magnetic north at said selected indexing coupling;

(b) measuring the orientation of said orienting slot with respect to magnetic north; and (c) referencing said measured orientation of said orienting slot in said well log.

14. The method of claim 11, further comprising:

(g) with said ultrasonic scanner rotating a wave generating element thus rotating an ultrasonic wave spot within said selected indexing coupling;

(h) measuring arrival time of a first ultrasonic wave reflection from the internal surfaces of said indexing coupling; and (i) processing said arrival time of said first ultrasonic wave reflection versus angle of rotation and versus depth to establish an acoustic image of said internal surfaces of said indexing coupling.

15. The method of claim 11, further comprising:

(g) operating a gyroscope contained in said logging sonde in combination with said ultrasonic scanner to provide an azimuthal reference to locate said orienting slot on said well log.

16. The method of claim 11, further comprising;

(g) operating a gamma ray system in said logging sonde in combination with said ultrasonic scanner to characterize the earth formation externally of said well casing for characterizing said earth formation in reference to said indexing coupling.

17. The method of claim 11, further comprising:

(g) simultaneous measuring of apparent depth measured along the internal wall of said well casing.

18. The method of claim 11, further comprising:

(g) simultaneously measuring tri-dimensional acceleration of said logging sonde.

19. The method of claim 11, further comprising:

(g) simultaneously measuring natural gamma ray energy across said well casing.

20. The method of claim 11, further comprising:

(g) simultaneously measuring the azimuth of said logging sonde with respect to magnetic north, measured with a gyroscope within said logging sonde in the event borehole deviation is in the low range of from about 5° to 10° or less.

21. The method of claim 11, further comprising:

(g) simultaneously measuring tri-dimensional acceleration of said logging sonde;

(h) simultaneously measuring natural gamma ray energy across said well casing; and (i) simultaneously measuring the azimuth of said logging sonde with respect to magnetic north, measured with a gyroscope within said logging sonde in the event wellbore deviation is in the low range of from about 5° to 10° or less.

22. A method for identifying and characterizing anomalies of and about the well casing of a well, comprising:

(a) running a logging sonde within said well casing, said logging sonde having an ultrasonic system therein for generating in well fluid within said well casing an ultrasonic wave and receiving ultrasonic wave reflections from said well casing and from anomalies located outwardly of said well casing;

(b) processing said ultrasonic wave reflections from said well casing and from said anomalies; and (c) utilizing said processed ultrasonic wave reflections to develop a well log identifying, locating and characterizing said well casing.

23. Apparatus for locating the position and orientation of one or more indexing devices within a well casing and having locating means and orienting means therein, said apparatus comprising:

(a) a well logging sonde adapted to be run within said well casing;

(b) an ultrasonic system within said well logging sonde for generating in well fluid within said well casing an ultrasonic wave and receiving ultrasonic wave reflections from the internal surface of said well casing and from the internal surface of said indexing device; and (c) means for processing said ultrasonic wave reflections and producing a well log having an acoustic image of the internal surface of said indexing devices including said locating means and said orienting means and referencing said acoustic image to local deviation and relative azimuth angle.

24. The apparatus of claim 23, wherein said ultrasonic system comprises:

(a) a rotatable element;

(b) means oriented by said rotatable element for generating an ultrasonic wave of narrow angular configuration and which is projected laterally and rotated about said internal surface of said well casing, said indexing device thus causing ultrasonic wave reflection from small sections of said internal surface; and wherein said processing means accomplishes processing of said wave reflections with respect to angle of rotation and with respect to depth for location thereof on said well log.

25. The apparatus of claim 23, further comprising:

(d) a gamma ray system incorporated within said logging sonde operated in combination with said ultrasonic system for characterization of the subsurface formation intersected by said well to thus provide for subsequent well service activities taking into account the location and orientation of said orienting means and characterization of said formation surrounding said well.

26. The apparatus of claim 23, further comprising:

(d) a gyroscope incorporated within said logging sonde operated in combination with said ultrasonic system to provide an azimuthal reference for locating said acoustic image on said well log.

27. The apparatus of claim 23, wherein: said logging sonde supports a combination of sensors simultaneously measuring:

(a) apparent depth of said logging sonde, measured along said well casing;

(b) tri-dimensional acceleration of said logging sonde;

(c) natural gamma ray energy measured across said well casing;

(d) internal geometry of said indexing devices by high resolution ultrasonic scanning; and (e) the azimuth of said logging sonde with respect to earth magnetic north;

and (f) referencing said acoustic image to local deviation and relative azimuth angle.

* * * * *